US005771738A

United States Patent [19]

Ko

[11] Patent Number: 5,771,738

[45] Date of Patent: Jun. 30, 1998

[54] RIVET-NUT TOOL WITH A FIXING HOLE

[76] Inventor: Yung-Chang Ko, 7th Fl.-1, No.21, Sec. 3, Minsheng E. Rd., Taipei, Taiwan

[21] Appl. No.: 909,701

[22] Filed: Aug. 12, 1997

[30] Foreign Application Priority Data

Dec. 26, 1996 [TW] Taiwan ..... 85220047

[51] Int. Cl.[6] ..... B21L 15/04

[52] U.S. Cl. ..... 72/391.8; 29/243.526; 29/243.527; 72/114

[58] Field of Search ..... 72/114, 391.8; 29/243.526, 243.527

[56] References Cited

U.S. PATENT DOCUMENTS

| | | | |
|---|---|---|---|
| 4,425,782 | 1/1984 | Todisco | 72/114 |
| 4,649,732 | 3/1987 | Molina | 72/114 |
| 5,079,818 | 1/1992 | Schwab | 29/243.527 |

FOREIGN PATENT DOCUMENTS

| | | | |
|---|---|---|---|
| 1394760 | 5/1975 | United Kingdom | 72/114 |
| 2172233 | 9/1986 | United Kingdom | 72/114 |

*Primary Examiner*—David Jones
*Attorney, Agent, or Firm*—Foley & Lardner

[57] ABSTRACT

A rivet-nut tool has a through hole defined in a collet case and a slot defined in a positioning seat, a pin extending into the through hole and the slot is able to retain the rotary mandrel and the positioning seat in a fixed position relative to the body of the rivet-nut tool, so that when a rivet nut is jammed onto the rotary mandrel, the rotary mandrel is able to disengage from the jammed rivet nut easily also convenient to change different sizes of rotary mandrel simply by using a wrench tool.

1 Claim, 4 Drawing Sheets

RIVET-NUT TOOL WITH A FIXING HOLE

FIELD OF THE INVENTION

The present invention generally relates to a rivet-nut tool, and more particularly to a rivet-nut tool having a through hole defined in a collet case thereof and a slot defined in a positioning seat thereof, such that when the through hole of the collet case and the slot of the positioning seat are aligned and then a pin is inserted therethrough respectively, a rotary mandrel and the positioning seat are fixed with a body of the rivet-nut tool, therefore, a badly deformed rivet nut is able to be disengaged from the rotary mandrel, and also convenient to change different sizes of rotary mandrel simply by using a wrench tool.

BACKGROUND OF THE INVENTION

When using a rivet-nut tool, firstly, a rivet nut is screwed onto a rotary mandrel of the rivet-nut tool. Once the rivet nut immediately touches a nosepiece of the rivet-nut tool, the rotary mandrel and the rivet nut are inserted into a predetermined hole in a work piece. The rivet nut is then deformed and fastened onto the work piece by forcing the rotary mandrel to move in a direction away from the work piece. Finally, the rotary mandrel is disengaged from the rivet nut and a fastening process of the rivet nut onto the work piece is completed.

There have been various designs for the rivet-nut tools introduced to the market. However, no matter what kind of design the rivet-nut tool may be, there is always a positioning seat for the rotary mandrel in order to provide secure engagement and disengagement to the rotary mandrel to facilitate the fastening process with the work piece. However, problems occur, such as, (1) the rivet nut may become jammed on the rotary mandrel when the rivet nut is forced to deform by pulling the rotary mandrel away from the rivet nut; (2) it is not easy to threadingly engage the rotary mandrel with or disengage the rotary mandrel from the positioning seat in that the positioning seat is freely and rotatably relative to the body of the rivet-nut tool.

It is noted that analysis of the problem (1) listed above reveals that the cause generally refers to the quality of the rivet nut. Such analysis shows that when the quality of the rivet nut is not well controlled, it is common to have deformations, eccentric hole and deformed threads long before the rivet nut is used. Again, if the quality of the rivet nut is not well controlled, the fastening process of the rivet nut onto the work piece will not be properly completed, because the deformation of the rivet nut to form a badly riveted bulge or the deformation process of the rivet nut goes too deep and causes destruction to the threads thereof. Either case discussed above will cause the rivet nut to become jammed onto the rotary mandrel. Encountering situations like these, users often have two options, one is to destroy the work piece and the other is to destroy parts of the rivet-nut tool. It is obvious that either to destroy the work piece or to destroy parts of the rivet-nut tool, will seriously damage and delay the process of work.

Analysis of the problem (2) shows that because the positioning seat is freely rotatable within the body of the rivet-nut tool, it is not easy to engage the rotary mandrel with or disengage the rotary mandrel from the positioning seat, such that when engaging the rotary mandrel with or disengaging the rotary mandrel from the positioning seat, it often needs more tools, such as two wrenches for the small size rivet tool, or more than one user for the large size rivet tool to complete the process.

From the previous description, it is noted that regardless of the quality control of the rivet nut, alternatives and/or improvement(s) are thus required. A rivet-nut tool constructed in accordance with the present invention tends to mitigate and/or obviate the aforementioned problems.

SUMMARY OF THE INVENTION

The main objective of the invention is to provide a rivet-nut tool having a through hole defined in a collet case thereof and a slot defined in a positioning seat thereof, such that when the through hole of the collet case and the slot of the positioning seat are aligned and a pin is inserted therethrough respectively, a rotary mandrel is fixed with a body of the rivet-nut tool, therefore, a badly deformed rivet nut is able to be disengaged from the rotary mandrel.

Other objects, advantages and novel features of the invention will become more apparent from the following detailed description when taken in conjunction with the accompanying drawings.

BRIEF DESCRIPTION OF THE DRAWINGS

The present invention will now be better understood with reference of the accompanying drawings wherein.

DETAILED DESCRIPTION OF THE PREFERRED EMBODIMENT

Figure 1:
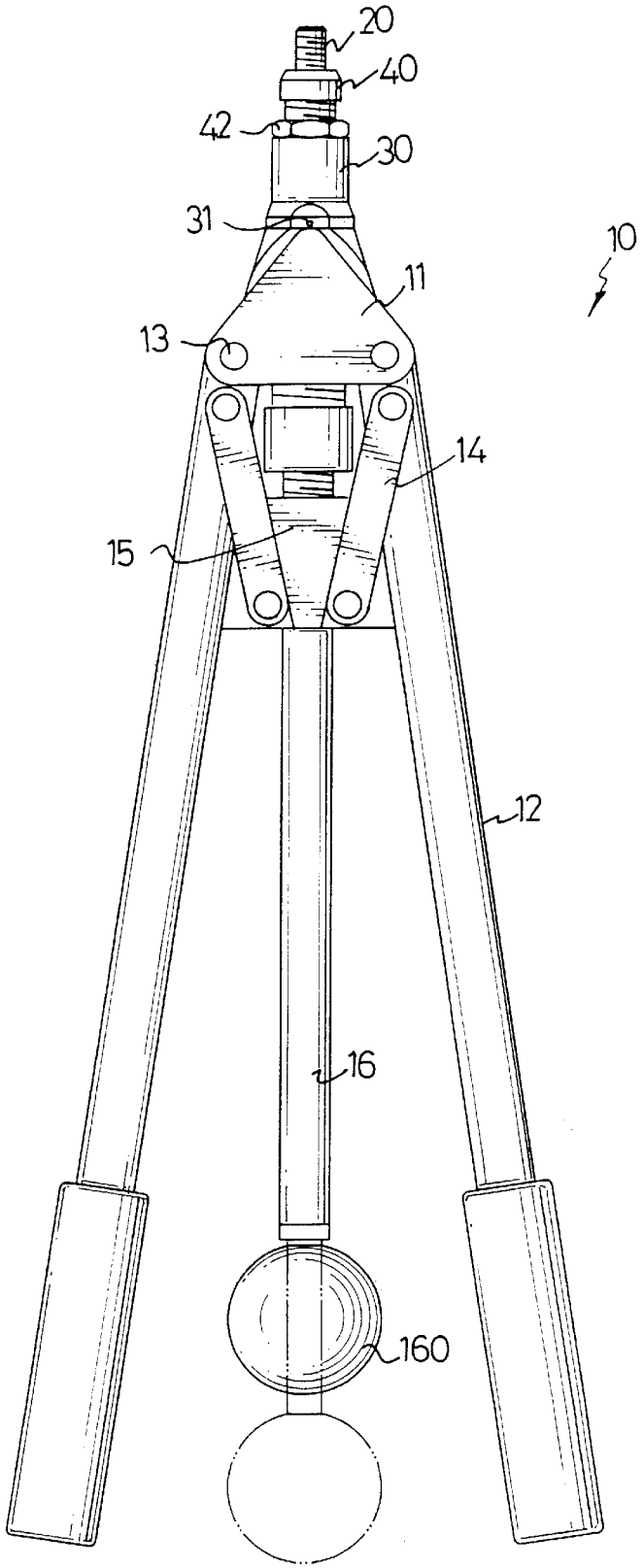
FIG. 1 is a plane view of a hand rivet-nut tool.

Referring to FIG. 1, one preferred embodiment of a hand rivet-nut tool 10 constructed in accordance with the present invention is shown. The embodiment intends in descriptive purpose and not in any form to limit the scope of the present invention, such that the features of the present invention also apply to various forms of rivet-nut tools, such as electric, pneumatic types of rivet-nut tools and even other types of hand rivet-nut tools.

In the preferred embodiment of FIG. 1, the hand rivet-nut tool 10 includes a body 11, a pair of handles 12 pivotally connected with the body 11, a block 15 respectively and pivotally connected with each of the pair of handles 12 via a pair of links 14, a drill unit 16 securely connected with the block 15 and extending outward therefrom, a sphere 160 detachably connected with a distal end (not numbered) of the drill unit 16, a hollow collet case 30 threadingly connected with the body 11, a hollow nosepiece 40 detachably connected with the collet case 30 via outer threads of the nosepiece 40 and inner threads of the collet case 30, a lock nut 42 threadingly connected to an outer periphery (not numbered) of the nosepiece 40 and a rotary mandrel 20 securely connected with a first end of a positioning seat 17 (see FIG. 3) and extending outward from the nosepiece 40; wherein the positioning seat 17 is freely rotatable within the body 11 and a second end of which is enclosed within the drill unit 16. Furthermore, a linear movement of the sphere 160 will drive the rotary mandrel 20 to rotate and since the connection between the rotary mandrel 20 and the positioning seat 17 with the sphere 160 is conventional, detailed description is omitted.

Figure 2:
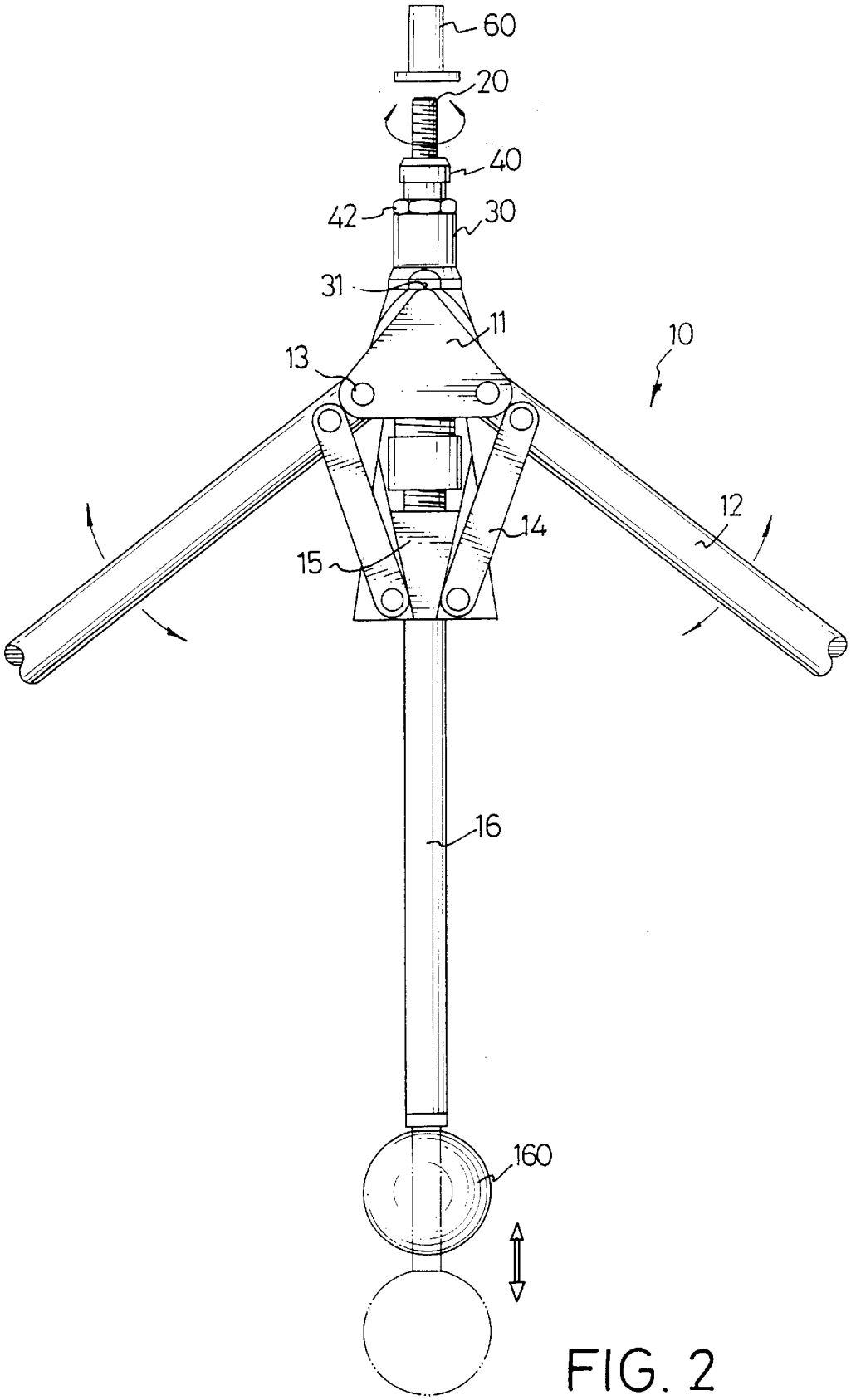
FIG. 2 is a schematic plane view of a preferred embodiment showing a wide open status of a pair of handles of the hand rivet-nut tool of FIG. 1.
Figure 6:
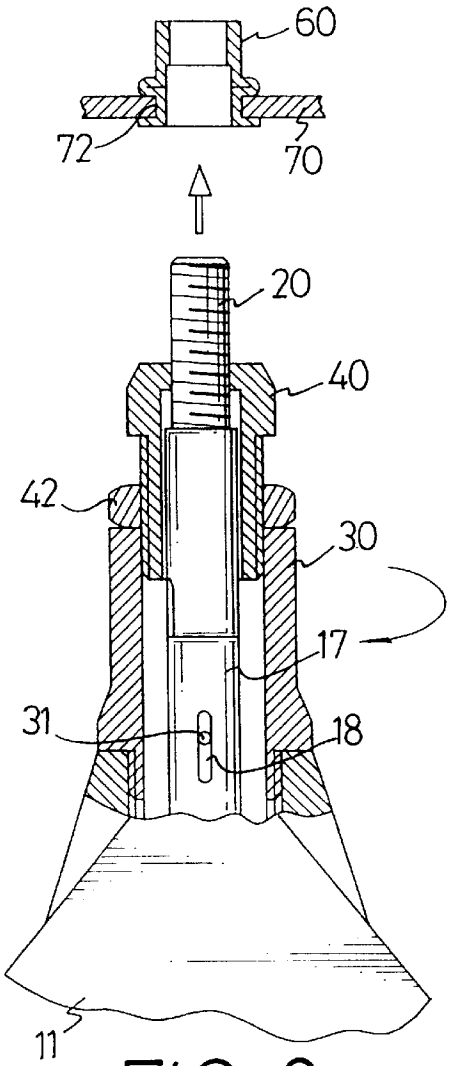
FIGS. 4 to 6 are schematic views showing the operations at these stages of the hand rivet-nut tool of FIG. 1.
Figure 5:
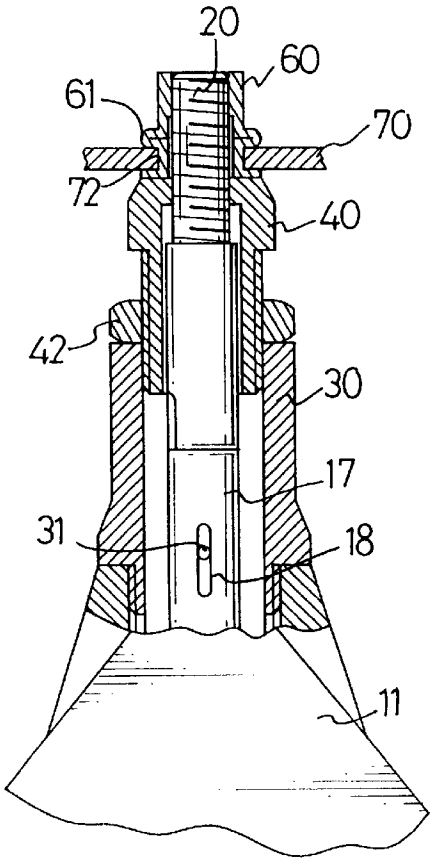
Figure 4:
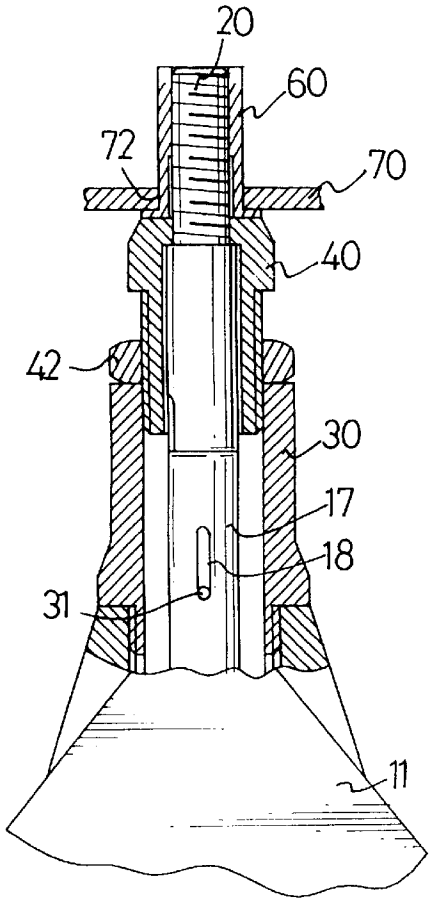

Referring to FIG. 2, when the handles 12 are widely opened by a user, the block 15 is accordingly moved toward the body 11 because of the links 14, and the rotary mandrel 20 extends further from the nosepiece 40. Pulling the sphere 160 away from the body 11 and disposing a rivet nut 60 onto the rotary mandrel 20, then pushing backward the sphere 160 enables the rivet nut 60 to be threadingly connected with the rotary mandrel 20. Afterward, as shown in FIG. 4, inserting the rivet nut 60 into a predetermined hole 72 defined in a work piece 70 and then pushing the two handles 12 toward each other, the rivet nut 60 will be forced to deform and a riveted bulge 61 is thus integrally formed and the rivet nut 60 is fastened onto the work piece 70, as shown in FIG. 5. After the rivet nut 60 is fastened onto the work piece 70, pulling backward the sphere 160 will thereby allowing the rotary mandrel 20 to disengage from the rivet nut 60, as shown in FIG. 6.

Figure 3:
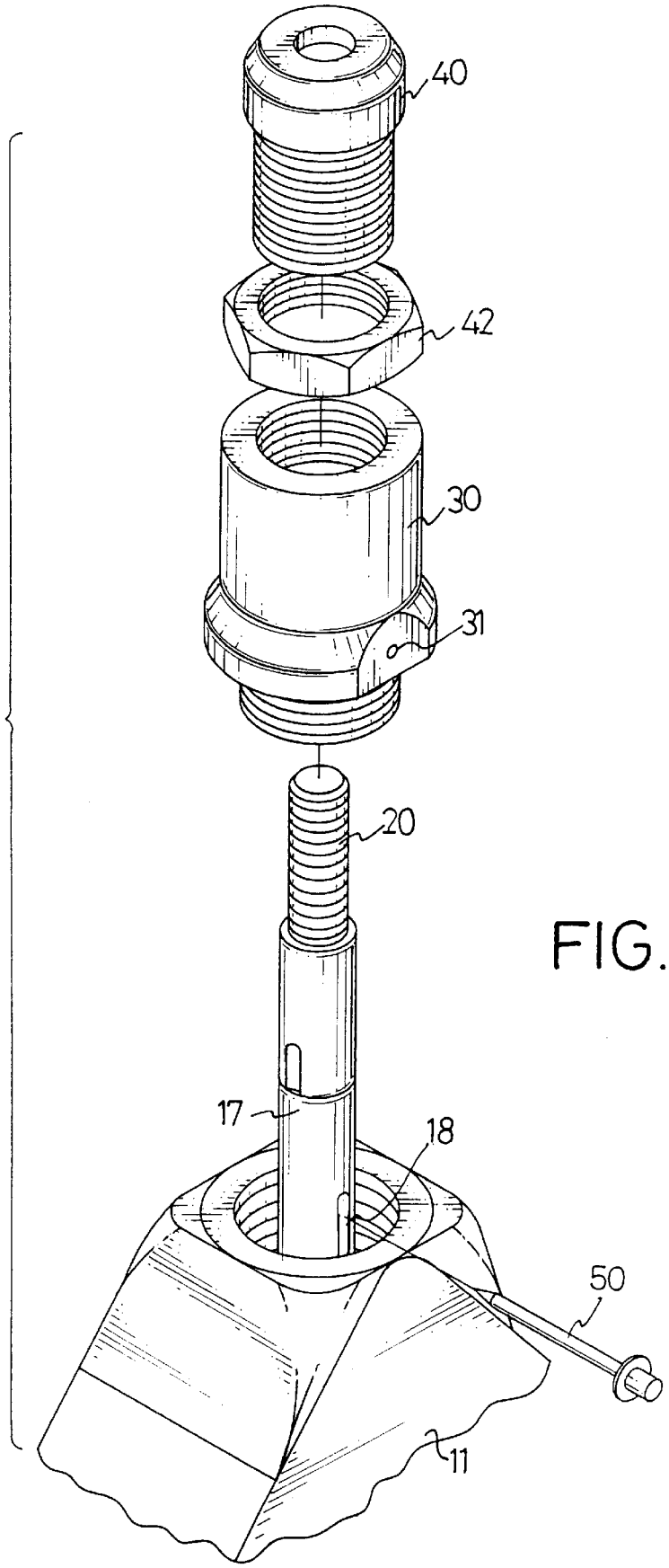
FIG. 3 is an exploded view of a front part of the hand rivet-nut tool showing features of the invention.

However, referring to FIG. 3, a through hole 31 is radially defined in the collet case 30 and a slot 18 is defined in the positioning seat 17. Due to the positioning seat 17 being freely rotatable relative to the body 11, so that when a rivet nut 60 is jammed onto the rotary mandrel 20 before entering into the work piece 70, it is hard to disengage the rivet nut 60 from the rotary mandrel 20. With the provision of the through hole 31 and the slot 18 and the alignment between each other, the rotary mandrel 20 is fixed relative to the body 11 when a pin 50 is respectively inserted into the through hole 31 and the slot 18. Then the user uses a clamping tool, such as a pair of pliers, to hold the jammed rivet nut 60, and the user will easily rotate the tool 10 counterclockwise to disengage the rotary mandrel 20 from the jammed rivet nut 60.

Yet, when the rivet nut 60 is threadingly connected with the rotary mandrel 20 and inserts into the predetermined hole 72 of the work piece 70, an abnormal deformation of the rivet nut 60 caused by the opening of the handles 12 will create a problem that the rotary mandrel 20 is not able to be disengaged from the rivet nut 60. When such a failure to disengage occurs, a user thus firstly loosens the nosepiece 40 to allow a clearance to be defined between the rivet nut 60 and the nosepiece 40. After a clearance is defined, the tool 10 is rotated clockwise or counterclockwise to align the through hole 31 of the collet case 30 with the slot 18 of the positioning seat 17 and the pin 50 is inserted into the through hole 31 and the slot 18, whereby the rotary mandrel 20 is fixed relative to the body 11 of the hand rivet-nut tool 10. Then, the user will easily rotate the tool 10 counterclockwise to disengage the rotary mandrel 20 from the jammed rivet nut 60.

It is, therefore, noted that a hand rivet-nut tool 10 having the through hole 31 defined in the collet case 30 and the slot 18 defined in the positioning seat 17 will enable the user to disengage the rotary mandrel 20 from the rivet nut 60 easily, and the user will not need to destroy either the work piece 70 or parts of the hand rivet-nut tool 10.

Furthermore, when replacing a rotary mandrel 20 with a rotary mandrel 20 of a different thread size, the user is able to use the same method described above to align the through hole 31 of the collet case 30 with the slot 18 of the positioning seat 17 and insert the pin 50 into the through hole 31 and the slot 18, whereby the positioning seat 17 is fixed relative to the body 11 of the hand rivet-nut tool 10, then a single user is able to use a single wrench tool easily to replace the rotary mandrel 20 with another different size of rotary mandrel 20, which is much more convenient than a conventional tool.

From the foregoing, it is seen that the objects hereinbefore set forth may readily and efficiently be attained, and since certain changes may be made in the above construction and different embodiments of the invention without departing from the scope thereof, it is intended that all matter contained in the above description or shown in the accompanying drawings shall be interpreted as illustrative and not in a limiting sense.

What is claimed is:

1. A hand rivet-nut tool comprising a body, a pair of handles pivotally connected with the body, a block respectively and pivotally connected with each of the pair of handles via a pair of links, a drill unit securely connected with the block and extending outward therefrom, a sphere detachably connected with a distal end of the drill unit, a hollow collet case threadingly connected with the body, a hollow nosepiece detachably connected with the collet case via a mating between outer threads of the nosepiece and inner threads of the collet case, a lock nut threadingly connected to an outer periphery of the nosepiece and a rotary mandrel securely connected with a first end of a positioning seat and extending outward from the nosepiece; wherein the improvements are:

said rotary mandrel is freely rotatable relative to said body and a slot is defined therein; said collet case has a through hole defined therein for alignment with said slot, such that a pin is able to extend into said through hole and said slot to retain said rotary mandrel and said positioning seat in a fixed position with the body of the hand rivet-nut tool.

* * * * *